US007352377B2

(12) United States Patent
Matsutomo

(10) Patent No.: US 7,352,377 B2
(45) Date of Patent: Apr. 1, 2008

(54) EXPOSURE DEVICE AND IMAGE FORMING APPARATUS

(75) Inventor: Yasushi Matsutomo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 199 days.

(21) Appl. No.: 11/113,689

(22) Filed: Apr. 25, 2005

(65) Prior Publication Data

US 2005/0243156 A1 Nov. 3, 2005

(30) Foreign Application Priority Data

Apr. 28, 2004 (JP) ..... 2004-133589

(51) Int. Cl.
*B41J 2/385* (2006.01)
*G03G 13/04* (2006.01)

(52) U.S. Cl. ..... 347/136; 347/134

(58) Field of Classification Search ..... 347/134, 347/135, 136

See application file for complete search history.

(56) References Cited

U.S. PATENT DOCUMENTS 5,068,677 A * 11/1991 Matsuura et al. ..... 347/241
6,036,299 A * 3/2000 Kobayashi et al. ..... 347/30
6,346,961 B1 * 2/2002 Schmid ..... 347/241
7,203,444 B2 * 4/2007 Yamazaki ..... 399/98
2005/0012973 A1 * 1/2005 Sowa et al. ..... 359/198

FOREIGN PATENT DOCUMENTS

JP 04-018857 U 2/1992
JP 11014925 A * 1/1999
JP 2000039578 A * 2/2000
JP 2001-138574 5/2001
JP 2002-072368 3/2002
JP 2002-148910 5/2002
JP 2003-287938 10/2003
JP 2004333799 A * 11/2004

* cited by examiner

*Primary Examiner*—Hai Pham
*Assistant Examiner*—Kainoa Wright
(74) *Attorney, Agent, or Firm*—Renner, Otto, Boisselle & Sklar, LLP

(57) ABSTRACT

An exposure device is provided with a shutter member having a slit. The shutter member is provided between a member to be scanned and a housing of a main device unit that has an optical transmission member. The shutter member is freely movable between an open position at which the slit is in opposition to the optical transmission member and a shut position at which the slit is not in opposition to the optical transmission member, and a light beam is irradiated through the optical transmission member and the slit to the member to be scanned. Furthermore, in the exposure device, a depressed portion is provided below the slit, and an aperture portion of the depressed portion is in opposition to the slit at least in a state where the shutter member is moved to the shut position at which a light path of the light beam is shut.

18 Claims, 9 Drawing Sheets

EXPOSURE DEVICE AND IMAGE FORMING APPARATUS

CROSS REFERENCE

This Nonprovisional application claims priority under 35 U.S.C. § 119(a) on Patent Application No. 2004-133589 filed in Japan on Apr. 28, 2004, the entire contents of which are hereby incorporated by reference.

BACKGROUND OF THE INVENTION

The present invention relates to an exposure device forming latent images by exposing members to be scanned (also referred to as "image carriers", provided in image forming portions that perform an electrophotographic image formation process to a light beam, such as a laser beam, modulated in accordance with image data. The present invention also relates to an image forming apparatus provided with such an exposure device.

Conventionally, image forming apparatuses such as copiers or printers are provided with an exposure device forming a static latent image by scanning an image carrier with a modulated light beam such as a laser beam. A light beam such as a laser beam is modulated based on image data of a read document or image data sent over, for example, a network. Image forming apparatuses perform image formation by transferring a developing agent image (hereinafter, referred to as "toner image") obtained by developing this static latent image via an intermediate transfer belt onto a recording medium.

Generally, such image forming apparatuses often use a laser beam exposure device as described above in which the modulation speed of the light beam is high, and thus the scanning speed is also high.

On the other hand, color image forming apparatuses that are capable of color image formation have become widespread recently, and thus there is a demand, for example, for higher image forming speeds, for smaller apparatuses, and for consistent image quality in image formation on various recording media (hereinafter, referred to as "paper") such as thick paper, thin paper or recycled paper.

For this reason, recent color image forming apparatuses are provided with a plurality of image forming portions performing an electrophotographic image formation process with different colors, and use a tandem structure for the intermediate transfer system in which color toner images formed on image carriers provided in the image forming portions are temporarily transferred to an intermediate transfer belt and then transferred to paper.

Thus, the only object on which color toner images are overlapped is the transfer belt, and thus stable image formation can be performed that is not affected by the paper type.

Furthermore, in such color image forming apparatuses using a tandem structure for the intermediate transfer system, an exposure device is provided below the image forming portions in view of, for example, downsizing and usability of the apparatus. The exposure device irradiates a light beam through optical transmission members (irradiation windows) made of glass or the like formed in a housing to image carriers above the exposure device.

However, when the exposure device is provided below the image forming portions, particle dust such as toner may drop from the image forming portions, so that the optical transmission members of the exposure device become dirty, and image writing defects may be caused. Particle dust such as toner tends to drop, for example, when a developing device performing development is operating during an image formation operation, or even outside image formation operation, when the developing device is exchanged.

For this reason, as is disclosed in JP 2002-148910A, a color image forming apparatus has been recently proposed that is provided with a shutter member opposing optical transmission members (seal glass) through which a light beam is irradiated so that the shutter member shuts the optical transmission members through which a light beam is irradiated at times in which no image formation operation is performed. Furthermore, in this color image forming apparatus, an airflow is formed in the vicinity of a light path of the light beam during image formation, so that the optical transmission members are prevented from becoming dirty with toner.

However, even when the optical transmission members are simply shut by the shutter member, there is a possibility that particle dust such as toner is accumulated on the shutter member or around the shutter member, for example, while the developing device is exchanged or while the apparatus is not used and on stand-by, and the accumulated particle dust, such as toner, may drop while the shutter member is operated to open the optical transmission members, so that the optical transmission members become dirty.

It is an object of the present invention to provide an exposure device with which particle dust, such as toner, accumulated on a shutter member or around the shutter member while the shutter member shuts optical transmission members can be prevented from adhering to the optical transmission members while the shutter member is operating. It is also an object of the present invention to provide an image forming apparatus provided with such an exposures device.

SUMMARY OF THE INVENTION

An exposure device of the present invention is provided with a shutter member having a slit, the shutter member being provided between a member to be scanned and a housing of a main device unit that has an optical transmission member, and being freely movable between an open position at which the slit is in opposition to the optical transmission member and a shut position at which the slit is not in opposition to the optical transmission member, and a light beam is irradiated through the optical transmission member and the slit to the member to be scanned. Furthermore, a depressed portion is provided below the slit, and an aperture portion of the depressed portion is in opposition to the slit at least in a state where the shutter member is moved to the shut position at which a light path of the light beam is shut.

Furthermore, an image forming apparatus of the present invention is provided with the exposure device, and performs image formation by transferring, onto a recording medium, a toner image obtained by developing a static latent image formed on a member to be scanned by irradiation of a light beam.

DESCRIPTION OF THE PREFERRED EMBODIMENTS

Figure 1:
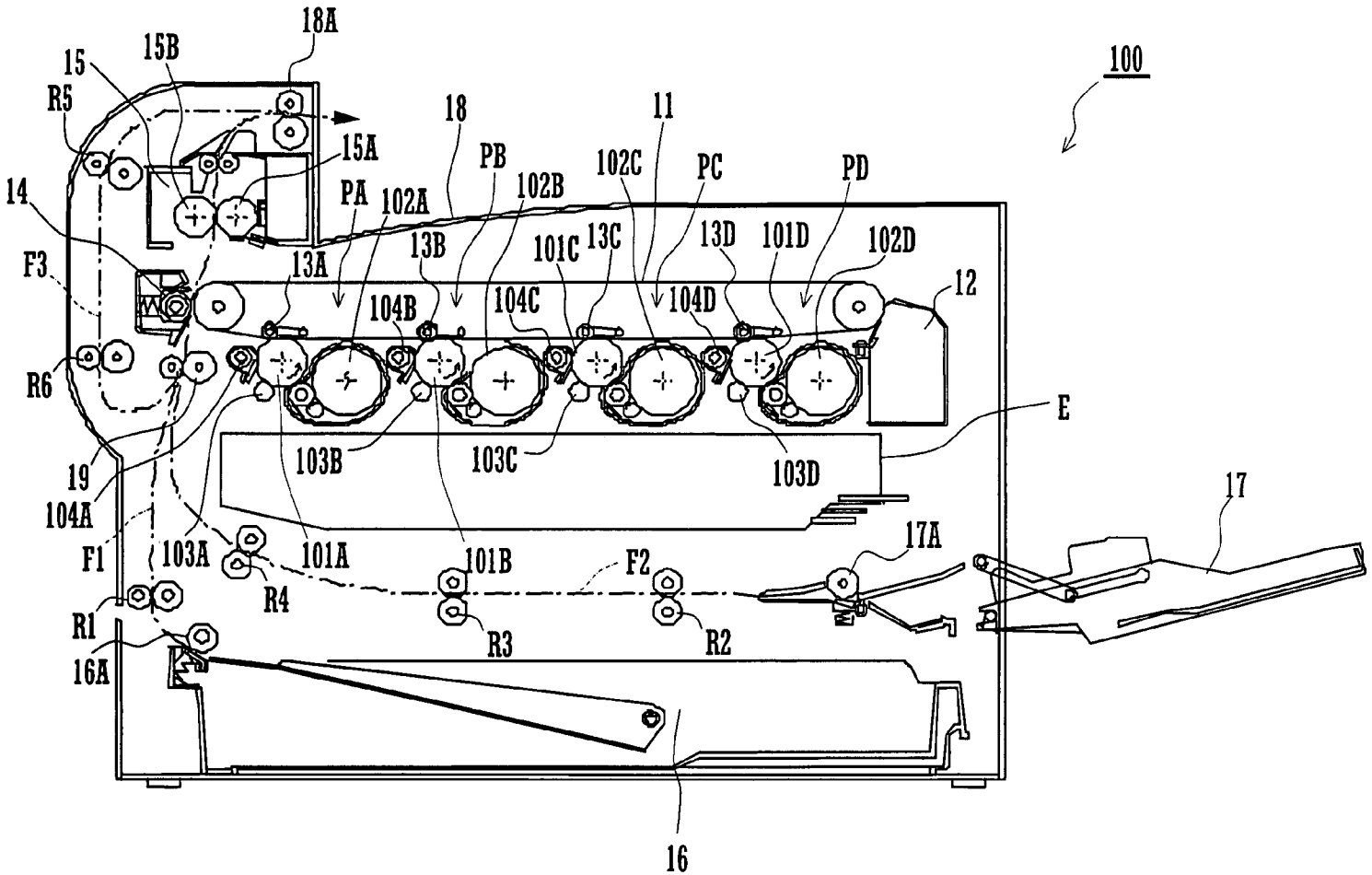
FIG. 1 is a cross-sectional view showing the simplified configuration of an image forming apparatus provided with an exposure unit according to an embodiment of the present invention.

FIG. 1 is a view showing the simplified configuration of an image forming apparatus provided with an exposure unit according to this embodiment of the present invention. An image forming apparatus 100 serving as a main device unit forms a multi-color or single-color image on paper based on image data of a read document or image data sent over, for example, a network. Therefore, the image forming apparatus 100 is provided with an exposure unit E, photosensitive drums (corresponding to members to be scanned in the present invention) 101A to 101D, developing units 102A to 102D, charge rollers 103A to 103D, cleaning units 104A to 104D, an intermediate transfer belt 11, primary transfer rollers 13A to 13D, a secondary transfer roller 14, a fixing device 15, paper transport paths F1, F2, and F3, a paper feed cassette 16, a manual paper feed tray 17, and a paper ejection tray 18, for example.

The image forming apparatus 100 performs image formation by using image data corresponding to each of the four colors black (K), as well as yellow (Y), magenta (M) and cyan (C), which are the three subtractive primaries obtained by separating colors of a color image. The four photosensitive drums 101A to 101D, the four developing units 102A to 102D, the four charge rollers 103A to 103D, the four transfer rollers 13A to 13D, and the four cleaning units 104A to 104D are provided in accordance with the four colors, and constitute four image forming portions PA to PD. The image forming portions PA to PD are arranged in line in the moving direction (sub scanning direction) of the intermediate transfer belt 11.

The charge rollers 103A to 103D are contact charging devices that charge the surfaces of the photosensitive drums 101A to 101D uniformly to a predetermined electric potential. It is also possible to use contact charging devices using charge brushes or non-contact charging devices using charge chargers, instead of the charge rollers 103A to 103D. The exposure unit E, which is an exposure device in the sense of the present invention, is provided with a semiconductor laser (not shown in the drawings), a polygon mirror 4, first reflection mirrors 7, and second reflection mirrors 8, for example, and irradiates light beams, such as laser beams, that are modulated in accordance with image data for the colors black, cyan, magenta and yellow, respectively, to the photosensitive drums 101A to 101D. On the photosensitive drums 101A to 101D, static latent images are formed based on the image data for the colors black, cyan, magenta and yellow.

The developing units 102A to 102D supply toner to the surfaces of the photosensitive drums 101A to 101D on which the static latent images have been formed, and make the static latent images visible in the form of toner images. The developing units 102A to 102D respectively contain toner of the colors black, cyan, magenta and yellow, and make the static latent images for each color formed on the photosensitive drums 101A to 101D visible in the form of toner images of the colors black, cyan, magenta and yellow. The cleaning units 104A to 104D remove and recover toner remaining on the surfaces of the photosensitive drums 101A to 101D after development and image transfer.

The intermediate transfer belt 11 provided above the photosensitive drums 101A to 101D is stretched around a driving roller 11A and a driven roller 11B, and forms a moving loop. The outer peripheral surface of the intermediate transfer belt 11 is in opposition to the photosensitive drum 101D, the photosensitive drum 101C, the photosensitive drum 101B and the photosensitive drum 101A in this order. The primary transfer rollers 13A to 13D are arranged at positions that are in opposition to the photosensitive drums 101A to 101D with the intermediate transfer belt 11 sandwiched between the primary transfer rollers 13A to 13D and the photosensitive drums 101A to 101D. The positions at which the intermediate transfer belt 11 is in opposition to each of the photosensitive drums 101A to 101D are primary transfer positions.

A primary transfer bias with the opposite polarity of the toner's polarity is applied to the primary transfer rollers 13A to 13D by constant voltage control in order to transfer the toner images carried on the surfaces of the photosensitive drums 101A to 101D onto the intermediate transfer belt 11. Thus, the color toner images formed on the photosensitive drums 101A to 101D are overlapped and transferred onto the outer peripheral surface of the intermediate transfer belt 11 one after another, and a full-color toner image is formed on the outer peripheral surface of the intermediate transfer belt 11.

It should be noted that when image data for only a subset of the colors yellow, magenta, cyan and black is input, static latent images and toner images are formed by only a subset of the photosensitive drums 101A to 101D corresponding to the colors of the input image data. For example, during monochrome image formation, a static latent image and a toner image are formed only at the photosensitive drum 101A corresponding to black color, and only a black toner image is transferred onto the outer peripheral surface of the intermediate transfer belt 11.

The primary transfer rollers 13A to 13D have a configuration in which the surface of a shaft made of a metal (stainless steel, for example) with a diameter of 8 to 10 mm is coated with a conductive elastic material (EPDM or urethane foam, for example), and uniformly apply a high voltage to the intermediate transfer belt 11 by the conductive elastic material.

The toner image transferred onto the outer peripheral surface of the intermediate transfer belt 11 at the primary transfer positions is transported to a secondary transfer position, which is a position opposed to the secondary transfer roller 14, by the rotation of the intermediate transfer belt 11. The secondary transfer roller 14 is pressed, at a predetermined nip pressure, against the outer peripheral surface of the intermediate transfer belt 11 whose inner peripheral surface is in contact with the peripheral surface of the driving roller 11A during image formation. While paper fed from the paper feed cassette 16 or the manual paper feed tray 17 passes between the secondary transfer roller 14 and the intermediate transfer belt 11, a high voltage with the opposite polarity of the toner's polarity is applied to the secondary transfer roller 14. Thus, the toner image is transferred from the outer peripheral surface of the intermediate transfer belt 11 to the surface of the paper.

It should be noted that of the toner adhered from the photosensitive drums 101A to 101D to the intermediate transfer belt 11, toner that has not been transferred onto the paper and remains on the intermediate transfer belt 11 is recovered by the cleaning units 12A to 12D in order to prevent color mixture in a later process.

The paper onto which the toner image has been transferred is guided to the fixing device 15 so that the paper passes between a heating roller 15A and a pressing roller 15B to be heated and pressed. Thus, the toner image is firmly fixed on the surface of the paper. The paper on which the toner image has been fixed is ejected by paper ejection rollers 18A to the paper ejection tray 18.

The image forming apparatus 100 is provided with a paper transport path F1 in the substantially vertical direction so that paper contained in the paper feed cassette 16 is sent through between the secondary transfer roller 14 and the intermediate transfer belt 11, and through the fixing device 15, to the paper ejection tray 18. Along the paper transport path F1, a pick-up roller 16A for sending paper in the paper feed cassette 16 onto the paper transport path F1 one by one, transport rollers R1 for transporting the sent paper upward, resist rollers 19 for guiding the transported paper between the secondary transfer roller 14 and the intermediate transfer belt 11 at a predetermined timing, and the paper ejection rollers 18A for ejecting the paper to the paper ejection tray 18 are arranged.

Furthermore, inside the image forming apparatus 100, a paper transport path F2 on which a pick-up roller 17A and transport rollers R2 to R4 are arranged is formed between the manual paper feed tray 17 and the resist rollers 19. In addition, a paper transport path F3 for double-sided image formation is formed between the paper ejection rollers 18A and the upstream side of the resist rollers 19 on the paper transport path F1. On the paper transport path F3, transport rollers R5 and R6 are arranged.

The paper ejection rollers 18A are freely rotatable in both the forward and the reverse direction, and are driven in the forward direction to eject paper to the paper ejection tray 18 during single-sided image formation in which an image is formed on one side of paper, and during the second side image formation of double-sided image formation in which an image is formed on both sides of paper. On the other hand, during the first side image formation of double-sided image formation, the paper ejection rollers 18A are driven in the forward direction until the rear edge of the paper passes through the fixing device 15, and are then driven in the reverse direction to guide the paper onto the paper transport path F3 for double-sided image formation in a state where the rear edge of the paper is held by the paper ejection rollers 18A. Thus, the paper on which an image is formed only on one side during double-sided image formation is guided onto the paper transport path F3 in a state where the paper is turned over and upside down.

The paper that has been fed from the paper feed cassette 16 or the manual paper feed tray 17, or has been transported through the paper transport path F3 is guided by the resist rollers 19 between the secondary transfer roller 14 and the intermediate transfer belt 11 at a timing that is synchronized with the rotation of the intermediate transfer belt 11. Thus, the rotation of the resist rollers 19 is stopped after the operation of the photosensitive drum 101 or the intermediate transfer belt 11 is started, and the movement of the paper that has been fed or transported prior to the rotation of the intermediate transfer belt 11 is stopped on the paper transport path F1 in a state where the front edge of the paper abuts against the resist rollers 19. Then, the rotation of the resist rollers 19 is started at a timing when the front edge portion of the paper is in opposition to the front edge portion of a toner image formed on the intermediate transfer belt 11 at a position where the secondary transfer roller 14 is pressed against the intermediate transfer belt 11.

It should be noted that during full-color image formation in which image formation is performed by all of the image forming portions PA to PD, all of the primary transfer rollers 13A to 13D press the intermediate transfer belt 11 against the photosensitive drums 101A to 101D. On the other hand, during monochrome image formation in which image formation is performed only by the image forming portion PA, only the primary transfer roller 13A presses the intermediate transfer belt 11 against the photosensitive drum 101A.

Figure 2:
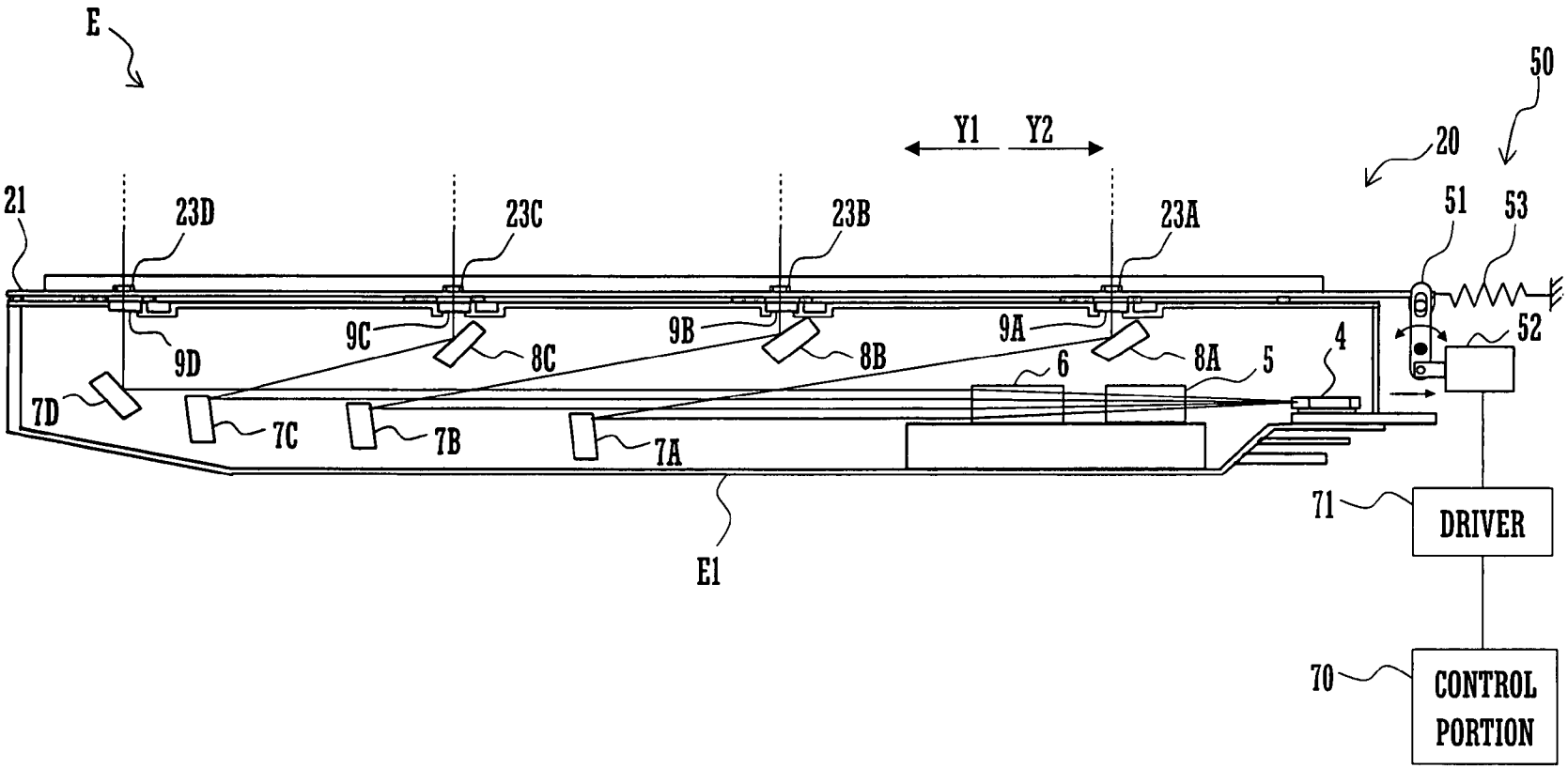
FIG. 2 is a cross-sectional view showing the simplified configuration of the exposure unit according to an embodiment of the present invention.

FIG. 2 is a view showing the simplified configuration of the exposure unit according to this embodiment of the present invention. The exposure unit E includes a housing E1 containing the semiconductor laser, the polygon mirror 4, a first fθ lens 5, a second fθ lens 6, first reflection mirrors 7A to 7D, second reflection mirrors 8A to 8C, cover glasses 9A to 9D, and a shutter device 20, for example.

The semiconductor laser irradiates light beams of the individual colors modulated based on image data, through a collimator lens (not shown in the drawings) or the like, onto the reflection surfaces of the polygon mirror 4. The polygon mirror 4 is a rotational polygon mirror, and rotates to reflect and deflect the light beams of the individual colors at a constant angular speed.

The first fθ lens 5 and the second fθ lens 6 perform fθ correction on the light beams of the individual colors that have been deflected at a constant angular speed to deflect them at an equal speed. Furthermore, the second fθ lens 6 deflects the light beams of the individual colors in parallel with the sub scanning direction perpendicular to the main scanning direction. The first reflection mirrors 7A to 7D and the second reflection mirrors 8A to 8C reflect and separate the light beams of the individual colors and guide them through cylindrical lenses (not shown in the drawings) and the cover glasses 9A to 9D to the photosensitive drums 101A to 101D.

Figure 3:
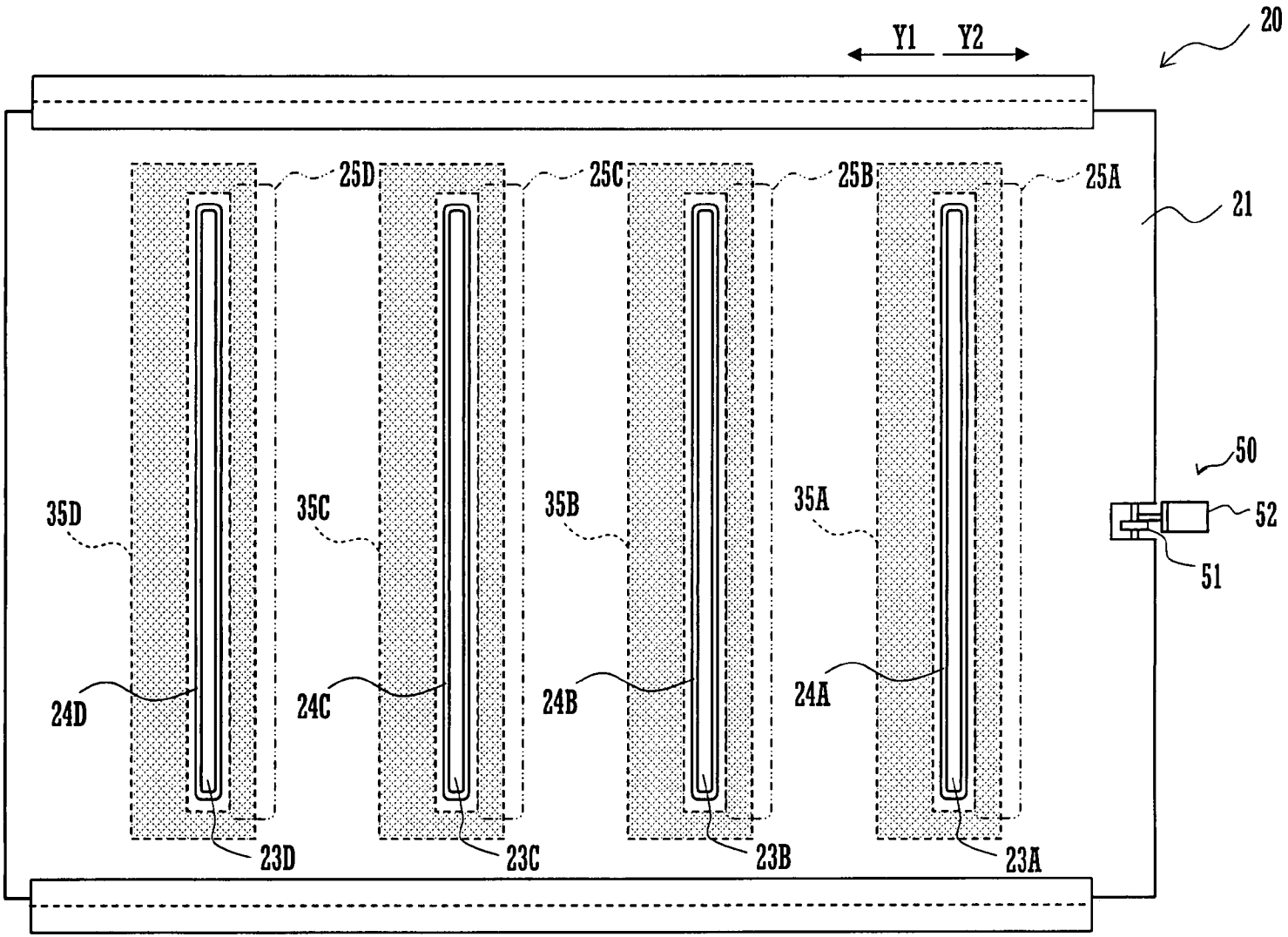
FIG. 3 is a top view showing the simplified configuration of a shutter device provided in the exposure unit according to an embodiment of the present invention.

The cover glasses 9A to 9D, which are optical transmission members in the sense of the present invention, are irradiation windows through which the light beams of the individual colors are irradiated from inside the housing E1 to the photosensitive drums 101A to 101D. The shutter device 20 includes a shutter member 21 and a driving device 50, for example, and shuts and opens the cover glasses 9A to 9D. The shutter member 21 is in the form of plate and is provided with slits 23A to 23D as shown in FIG. 3.

Furthermore, the shutter member 21 is supported by the main device unit in a freely slidable (movable) manner in the directions of arrows Y1 and Y2 that are perpendicular to the light path of the light beam and that are perpendicular to the main scanning direction, and protects the cover glasses 9A to 9D from particle dust such as toner. The slits 23A to 23D let the light beams pass through when the slits 23A to 23D are in opposition to the cover glasses 9A to 9D.

The driving device 50 includes a pivoting member 51, a solenoid 52, and a spring 53, for example. The pivoting member 51 is supported by the main device unit in a freely pivotable manner, and has its one end connected to the shutter member 21 and the other end connected to the solenoid 52. When the solenoid 52 is on, the pivoting member 51 is pivoted and slide the shutter member 21 in the direction of arrow Y1. The spring 53 has its one end connected to the shutter member 21 and the other end connected to the main device unit, and applies a force to the shutter member 21 in the direction of arrow Y2.

A control portion 70 switches the solenoid 52 on/off via a driver 71. The control portion 70 controls the entire operation of the main device unit.

Figure 4A:
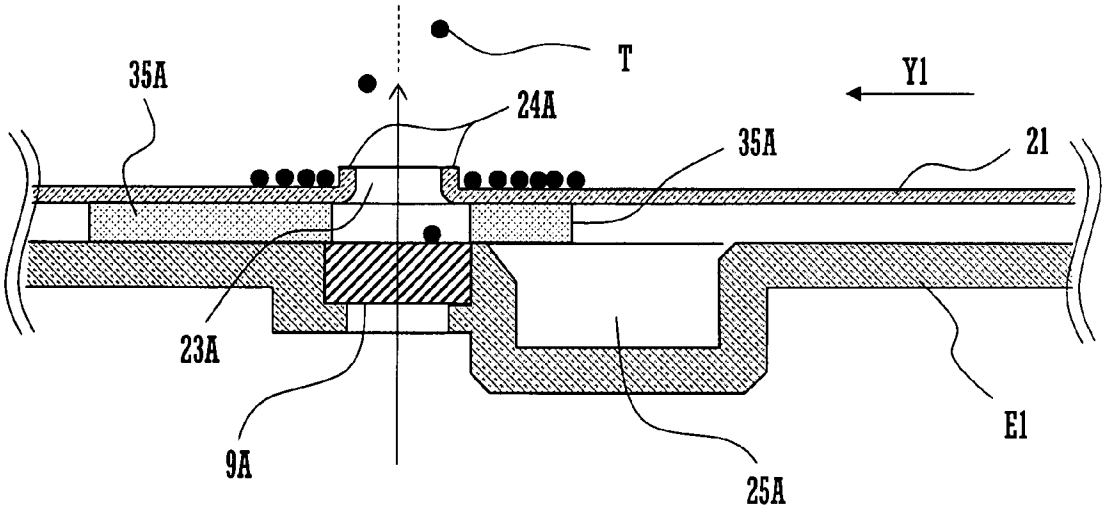
FIGS. 4A and 4B are enlarged views of a portion of the exposure unit according to an embodiment of the present invention.
Figure 4B:
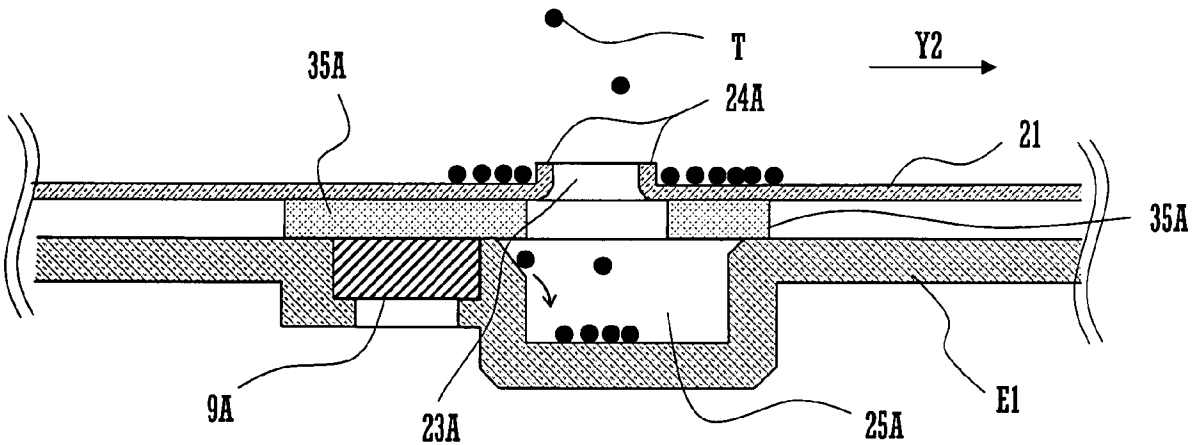

FIGS. 4A and 4B show enlarged views of a portion of the exposure unit according to this embodiment of the present invention. As shown in FIG. 4A, when the solenoid 52 is on, the shutter member 21 is slid in the direction of arrow Y1 in such a manner that the slits 23A to 23D are in opposition to the cover glasses 9A to 9D, and thus the light beams can be irradiated. Furthermore, as shown in FIG. 4B, when the solenoid 52 is off, the shutter member 21 is slid to a shut position by the elasticity of the spring 53 in such a manner that the slits 23A to 23D are not in opposition to the cover glasses 9A to 9D, and thus the cover glasses 9A to 9D are shut.

The shutter member 21 is slid in the directions of arrows Y1 and Y2 to shut and open the cover glasses 9A to 9D, because if the cover glasses 9A to 9D are kept open, particle dust such as a toner T is adhered and the cover glasses 9A to 9D become dirty.

The exposure unit E is provided with depressed portions 25A to 25D and seal members 35A to 35D. As shown in FIG. 4B, the depressed portions 25A to 25D are arranged on the upper surface of the housing E1 at positions where aperture portions of the depressed portions 25A to 25D are in opposition to the slits 23A to 23D in a state where the shutter member 21 is positioned at the shut position. Furthermore, particle dust such as the toner T dropped through the slits 23A to 23D is accumulated in the depressed portions 25A to 25D.

Thus, particle dust such as the toner T dropped through the slits 23A to 23D in a state where the cover glasses 9A to 9D are shut can be accumulated in the depressed portions 25A to 25D, and thus the accumulated particle dust such as the toner T can be prevented from being stirred up due to the movement of the shutter member 21, for example, and from adhering to the cover glasses 9A to 9D. Thus, it can be ensured that the light beams of the individual colors are irradiated accurately from the exposure unit E to the photosensitive drums 101A to 101D, so that image quality can be ensured.

A short side of each of the slits 23A to 23D is parallel to the directions of arrows Y1 and Y2. A long side of each of the slits 23A to 23D is perpendicular to the directions of arrows Y1 and Y2. Length of the short side is shorter than that of a short side of each of the aperture portions of the depressed portions 25A to 25D. Length of the long side is shorter than that of a long side of each of the aperture portions of the depressed portions 25A to 25D. Thus, the slits 23A to 23D are positioned inside the depressed portions 25A to 25D when looked on from above.

Thus, particle dust such as the toner T dropped through the slits 23A to 23D in a state where the shutter member 21 is positioned at the shut position can be reliably accumulated in the depressed portions 25A to 25D, and thus the particle dust such as the toner T can be properly prevented from being stirred up due to the movement of the shutter member 21, for example, and from adhering to the cover glasses 9A to 9D.

The single shutter device 20 is provided with the plurality of slits 23A to 23D respectively corresponding to the plurality of cover glasses 9A to 9D, and thus all of the cover glasses 9A to 9D can be shut or opened by the movement of the single shutter member 21, so that it is possible to make the control and the configuration simple. It is also possible to prevent the cost from increasing.

The seal members 35A to 35D have their upper surfaces fixed to the shutter member 21 and their lower surfaces abutting against the upper surface of the housing E1, and move in accordance with the sliding of the shutter member 21 in the directions of arrows Y1 and Y2. Furthermore, the seal members 35A to 35D are arranged over the entire circumference of the slits 23A to 23D as shown in FIG. 3, and the lower surfaces of the seal members 35A to 35D are in contact with the entire circumference of the edge of the aperture portions of the depressed portions 25A to 25D in a state where the shutter member 21 is positioned at the shut position as shown in FIG. 4B.

Thus, particle dust such as the toner T can be prevented from entering through the slits 23A to 23D between the shutter member 21 and the upper surface of the housing E1. Consequently, the particle dust such as the toner T entered through the slits 23A to 23D can be reliably prevented from accumulating on the upper surface of the housing E1 except for the depressed portions 25A to 25D.

The lower surfaces of the seal members 35A to 35D abut against the entire circumference of the edge of the aperture portions of the depressed portions 25A to 25D in a state where the shutter member 21 has slid to the shut position, and thus the particle dust such as the toner T dropped through the slits 23A to 23D in a stand-by state where the shutter member 21 has slid to the shut position at which the cover glasses 9A to 9D are shut can be reliably accumulated in the depressed portions 25A to 25D.

The shutter device 20 is provided with projection portions 24A to 24D extending toward the photosensitive drums 101A to 101D over the entire circumference of the edge of the slits 23A to 23D. The upper surface of the shutter member 21 is exposed to the image forming portions PA to PD such as the photosensitive drums 101A to 101D, and thus particle dust easily accumulates on the upper surface. Here, with the above configuration, the particle dust such as the toner T accumulated on the upper surface of the shutter member 21 can be prevented from dropping through the slits 23A to 23D when the shutter member 21 moves in the directions of arrows Y1 and Y2, so that the particle dust can be prevented from adhering to the cover glasses 9A to 9D.

Figure 5:
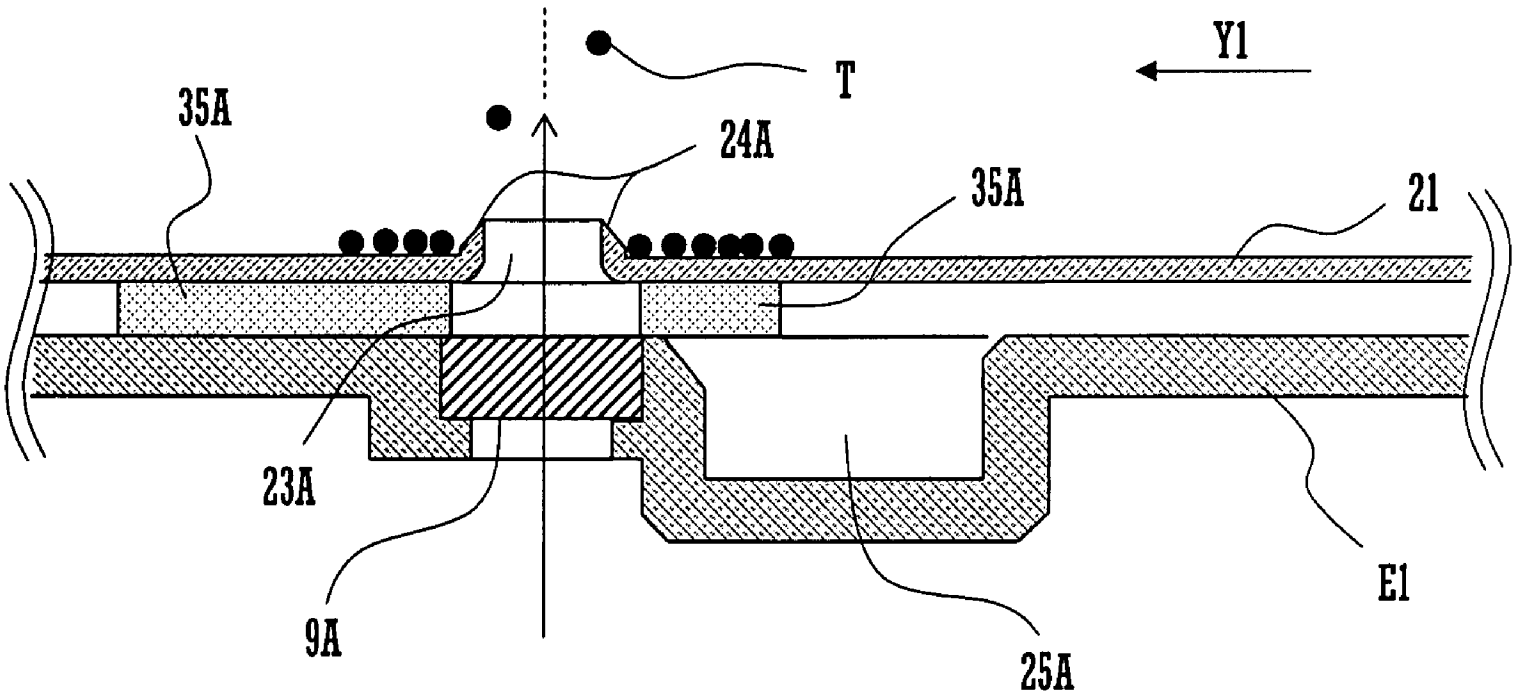
FIG. 5 is an enlarged view of a portion of the exposure unit according to an embodiment of the present invention.

Furthermore, the cross-sectional shape of the open ends of the projection portions 24A to 24D in the direction of arrow Y1 may be inclined in the direction from the edge to the center of the slits 23A to 23D with respect to the light path direction as shown in FIG. 5. Thus, when particle dust such as the toner T drops onto the open ends of the projection portions 24A to 24D, the particle dust such as the toner T can be prevented from adhering to the open ends, so that the particle dust such as the toner T can be properly prevented from adhering to the cover glasses 9A to 9D when the shutter member 21 slides.

Furthermore, the shutter member 21 moves from the shut position to the position where the cover glasses 9A to 9D are opened when a request for image formation by irradiation of a light beam is received and an image formation operation is started, for example, and moves to the shut position where the cover glasses 9A to 9D are shut when paper is ejected to the paper ejection tray 18 and the image formation operation is ended.

In this embodiment of the present invention, the projection portions 24A to 24D are arranged over the entire circumference of the edges of the slits 23A to 23D, but there is no limitation to this, and a similar effect can be achieved if the projection portions 24A to 24D are arranged at least on the arrow Y1 and Y2 direction side of the slits 23A to 23D.

The seal members 35A to 35D are made of sponge, for example, and move in accordance with the sliding of the shutter member 21 to scrape the cover glasses 9A to 9D. Thus, even when particle dust such as the toner T is adhered and the cover glasses 9A to 9D become dirty, the dirt can be removed. Thus, the seal members 35A to 35D also correspond to cleaning members in the sense of the present invention.

When the cover glasses 9A to 9D are opened so that light beams are irradiated, an image formation operation is performed by the image forming portions P, and thus particle dust such as the toner T tends to be dropped. Thus, the particle dust such as the toner T tends to drop through the slits 23A to 23D onto the cover glasses 9A to 9D.

Figure 6:
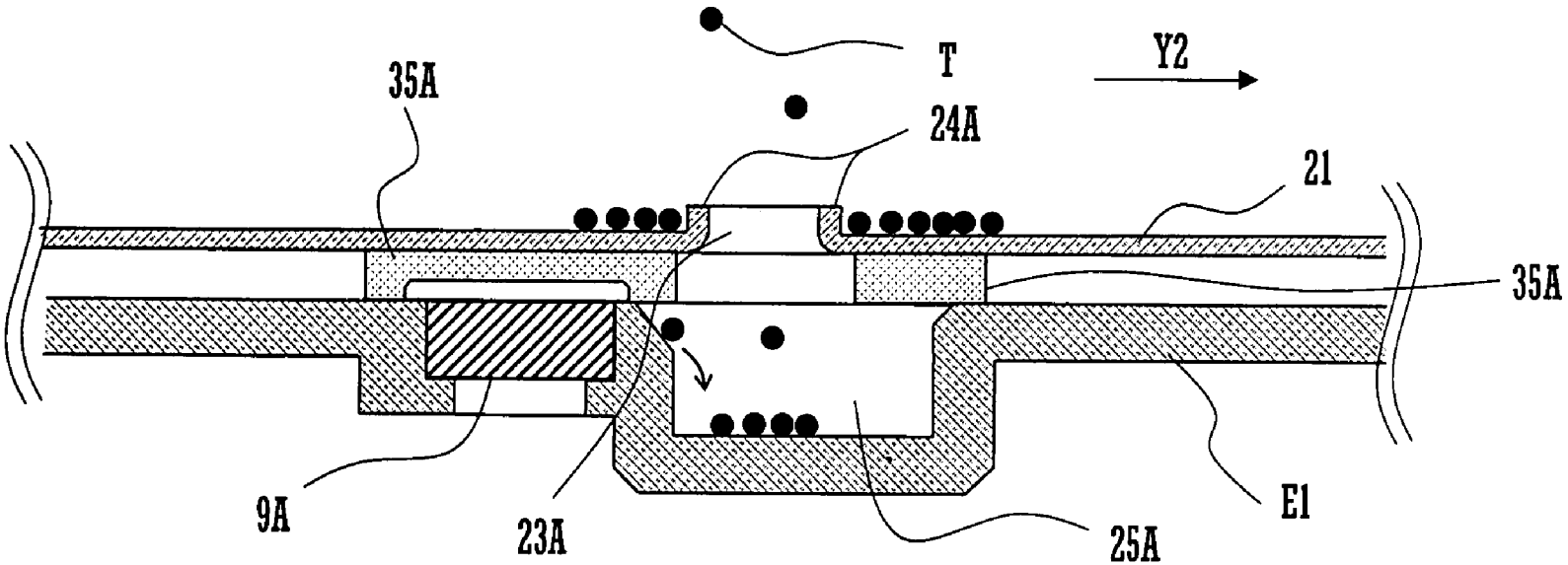
FIG. 6 is an enlarged view of a portion of the exposure unit according to an embodiment of the present invention.

In order to reduce a frictional load between the housing E1 and the cover glasses 9A to 9D, the surface area of the abutting surfaces of the seal members 35A to 35D can be reduced as shown in FIG. 6.

Figure 7A:
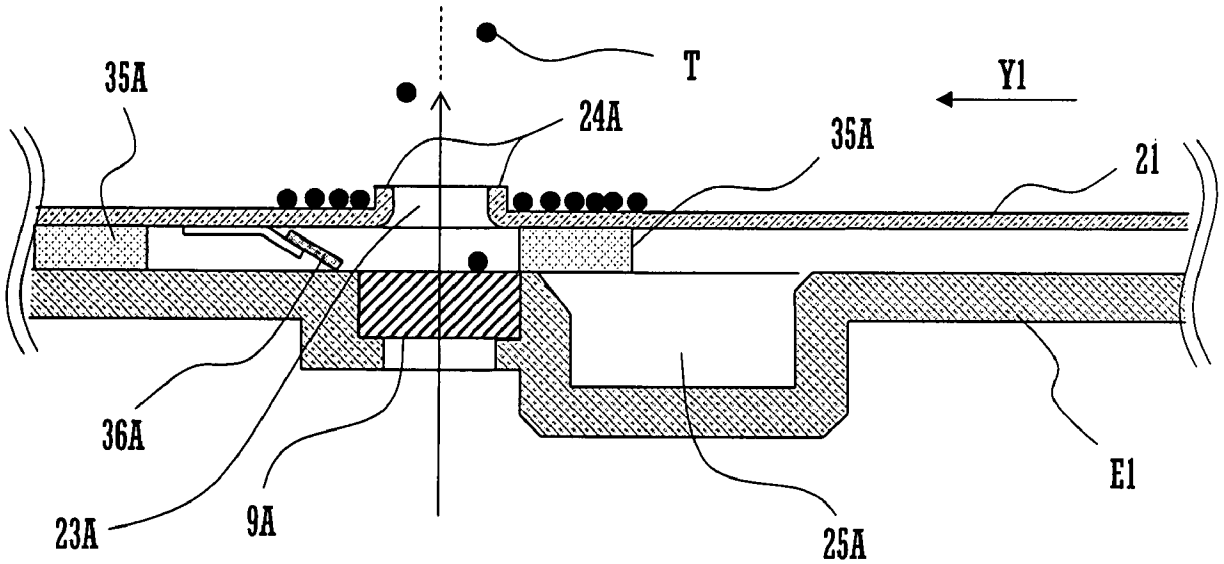
FIGS. 7A and 7B are enlarged views of a portion of the exposure unit according to an embodiment of the present invention.
Figure 7B:
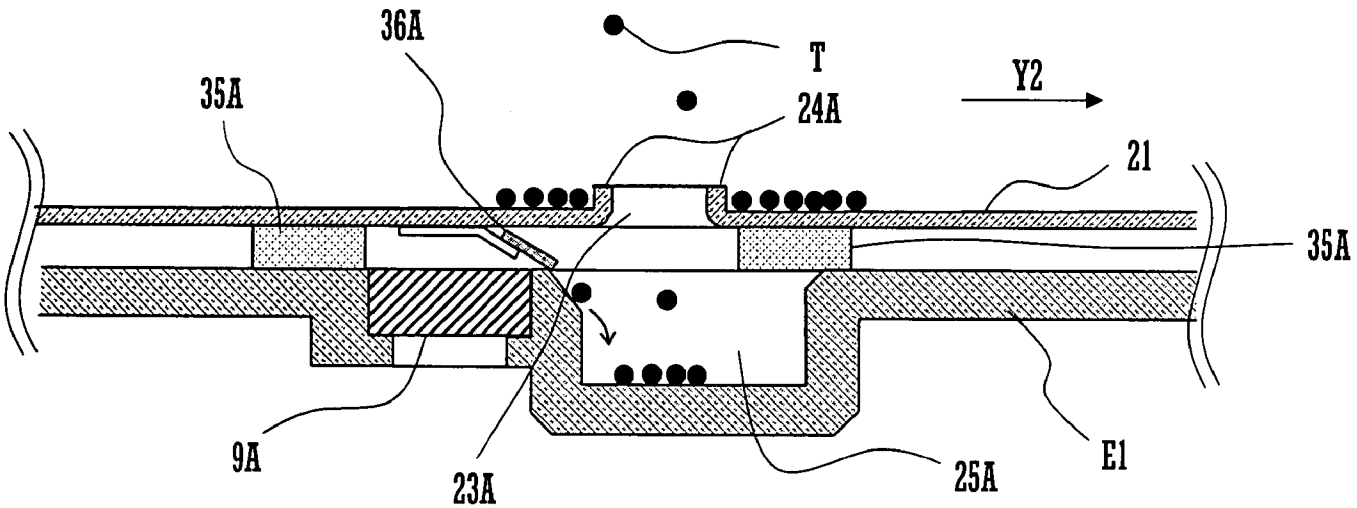

Furthermore, for a portion of the seal members 35A to 35D, blades 36A to 36D, which are cleaning members in the sense of the present invention, may be used as shown in FIGS. 7A and 7B. When the blades 36A to 36D are used, the scraping action with respect to the cover glasses 9A to 9D can be further improved.

Figure 8:
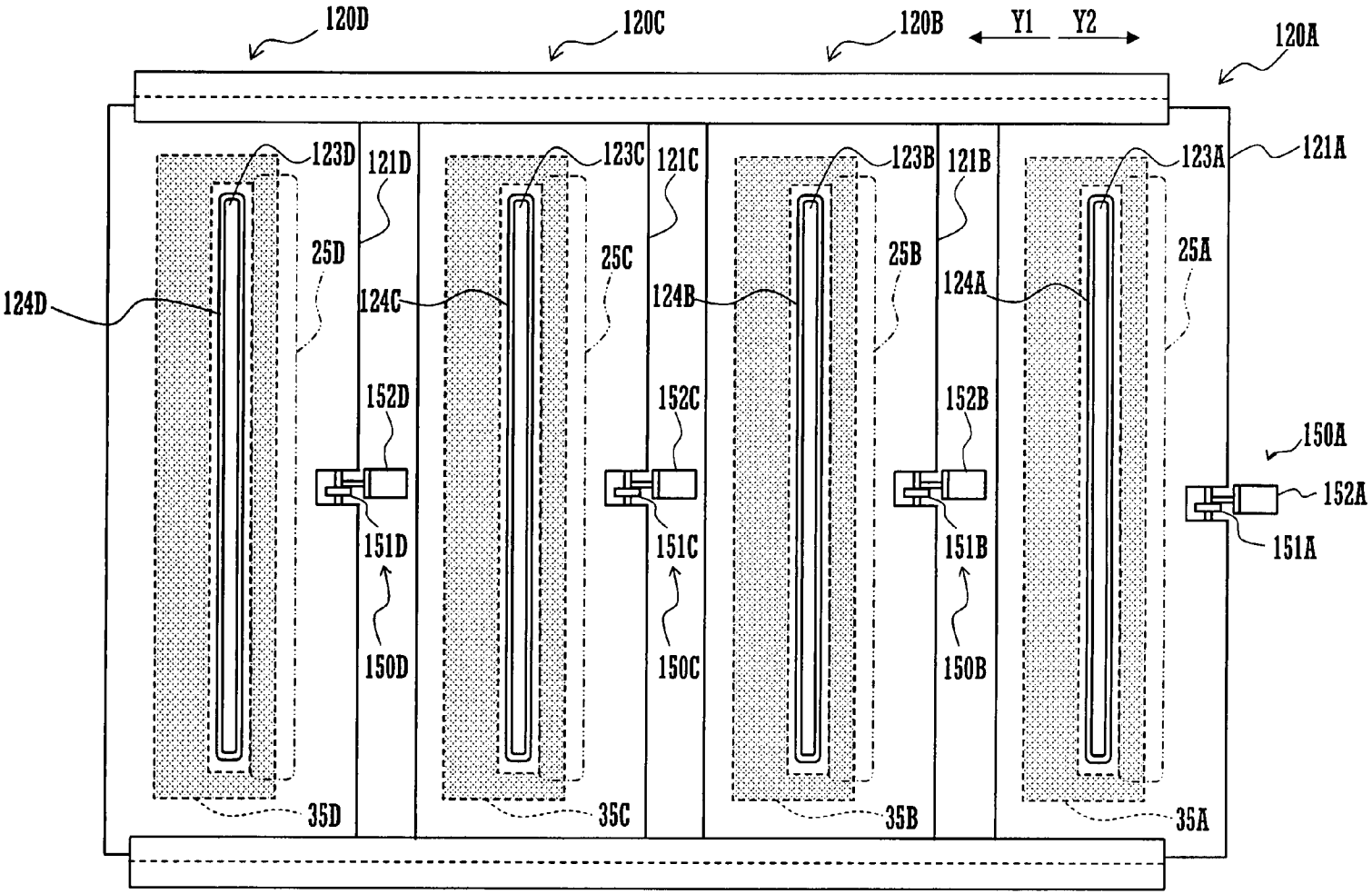
FIG. 8 is a top view showing the simplified configuration of the shutter device provided in the exposure unit according to an embodiment of the present invention.

Furthermore, in this embodiment of the present invention, a single shutter device 20 is used, but there is no limitation to this. For example, a configuration is possible in which the photosensitive drums 101A to 101D are respectively provided with shutter devices 120A to 120D as shown in FIG. 8. The shutter devices 120A to 120D are each provided with one shutter member 121A to 121D, one slit 123A to 123D, one projection portion 124A to 124D, and one driving device 150A to 150D, for example.

Solenoids 152A to 152D provided in the driving devices 150A to 150D are each connected via corresponding drivers (not shown in the drawings) to a control portion (not shown in the drawings). The control portion switches the solenoids 152A to 152D on/off in accordance with an irradiation timing of light beams of the individual colors to slide the shutter members 121A to 121D by means of pivoting members 151A to 151D.

Thus, it is possible that the cover glasses 9A to 9D are only opened when necessary, and thus a time during which the cover glasses 9A to 9D are opened can be shorter than in the case of the device provided with the single shutter member 21 having the plurality of slits 23A to 23D, so that particle dust such as the toner T tends to drop less through the slits 123A to 123D onto the cover glasses 9A to 9D.

Figure 9:
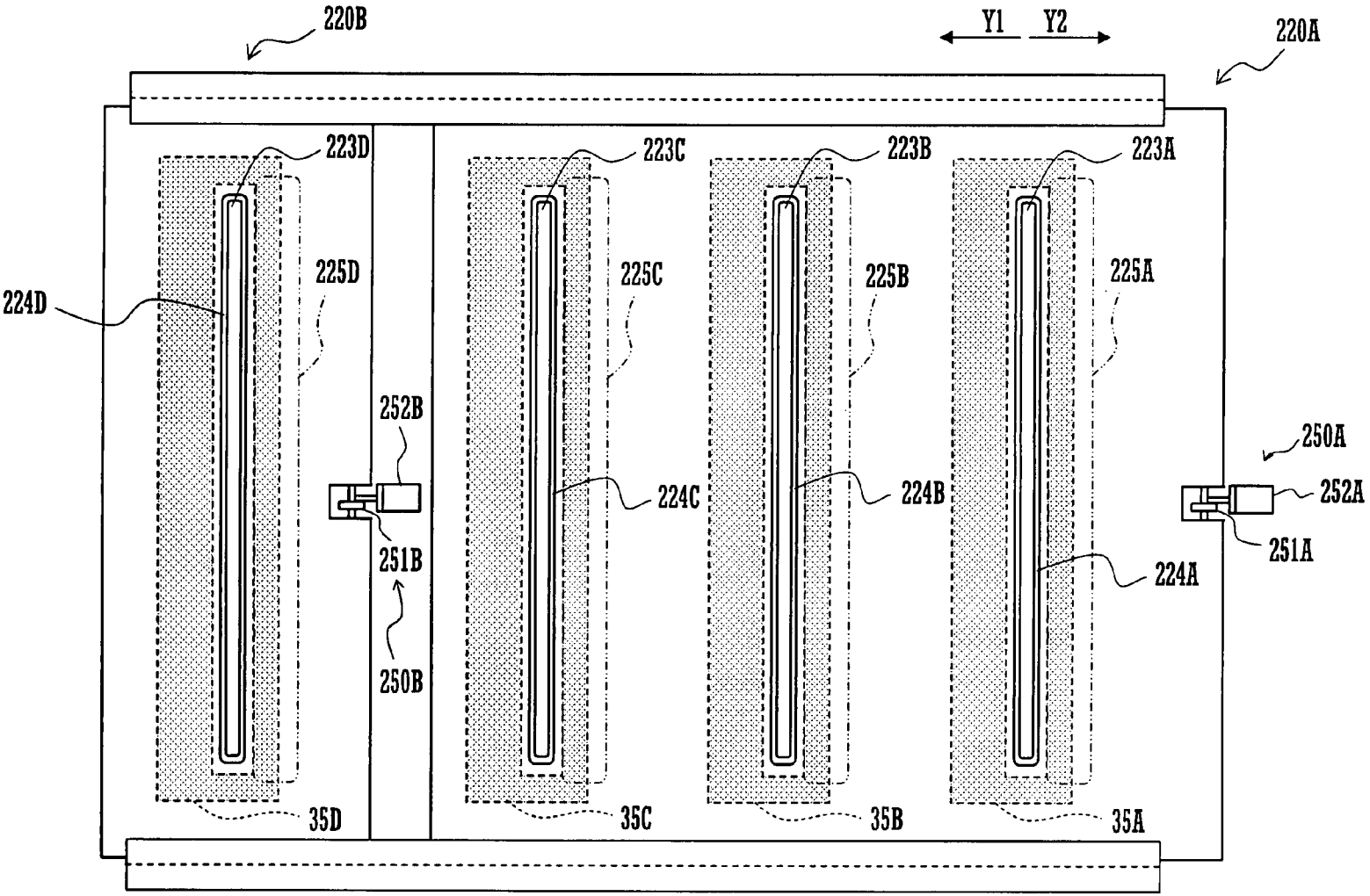
FIG. 9 is a top view showing the simplified configuration of the shutter device provided in the exposure unit according to an embodiment of the present invention.

Furthermore, a configuration is possible in which a shutter device 220A for color images and a shutter device 220B for monochrome images are arranged as shown in FIG. 9. The shutter device 220A for color images is provided with slits 223A to 223C corresponding to the photosensitive drums 101A to 101C for yellow, magenta and cyan used during color-image formation, a single shutter member 221A having projection portions 224A to 224C, and a driving device 250A. The shutter device 220B for monochrome images is provided with a slit 223D corresponding to the photosensitive drum 101D for black used during monochrome image formation, a single shutter member 221B having a projection portion 224D, and a driving device 250B.

Solenoids 252A and 252B provided in the driving devices 250A and 250B are each connected via corresponding drivers (not shown in the drawings) to a control portion (not shown in the drawings). When a color-image formation operation is started, the control portion switches on the solenoid 252A for color images and the solenoid 252B for monochrome images to open all of the cover glasses 9A to 9D by means of a pivoting member 251A and a pivoting member 251B. Furthermore, when a monochrome image formation operation is started, the control portion switches on only the solenoid 252B for monochrome images to open only the cover glass 9D by means of the pivoting member 251B.

Thus, whether or not the cover glasses 9A to 9C for full-color images and the cover glass 9D for monochrome images are opened is different between during full-color image formation and during monochrome image formation, and thus it is possible to prevent the control and the configuration from being complicated and also to prevent the cost from increasing.

It should be noted that particle dust such as the toner T accumulated in the depressed portions 25A to 25D can be removed when the exposure unit E is removed from the main device unit.

Furthermore, in this embodiment of the present invention, the exposure unit E built into an image forming apparatus is used for the explanation, but there is no limitation to this, and any device may be used as long as the device irradiates a light beam to a member to be scanned.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An exposure device comprising a shutter member having a slit, the shutter member being provided between a member to be scanned and a housing of a main device unit that has an optical transmission member, and being freely movable between an open position at which the slit is in opposition to the optical transmission member and a shut position at which the slit is not in opposition to the optical transmission member, a light beam being irradiated through the optical transmission member and the slit to the member to be scanned, wherein a depressed portion is provided below the slit, an aperture portion of the depressed portion being in opposition to the slit at least in a state where the shutter member is moved to the shut position at which a light path of the light beam is shut, wherein lengths of the slit in a moving direction of the shutter member and in a direction perpendicular to the moving direction are shorter than lengths of the aperture portion, and wherein a seal member is provided on the slit, a lower surface of the seal member being in contact with an entire circumference of an edge of the aperture portion in a state where the shutter member is moved to the shut position.

2. The exposure device according to claim 1,
wherein an upper surface of the seal member is fixed to the shutter member.

3. The exposure device according to claim 2,
wherein the seal member includes a cleaning member that scrapes the optical transmission member.

4. The exposure device according to claim 3,
wherein the cleaning member is a blade.

5. The exposure device according to claim 1,
wherein the shutter member is provided with a projection portion extending toward the side opposed to the member to be scanned, of an edge of the slit at least on the moving direction side of the shutter member.

6. The exposure device according to claim 5,
wherein a cross-sectional shape of an open end of the projection portion in the moving direction of the shutter member is inclined in a direction from an edge to a center of the slit with respect to the light path of the light beam.

7. The exposure device according to claim 1,
wherein the housing has a plurality of said optical transmission members, and
wherein the shutter member is provided with a plurality of said slits respectively corresponding to the plurality of optical transmission members.

8. The exposure device according to claim 1,
wherein the housing has a plurality of said optical transmission members, and
wherein the shutter member includes a plurality of portions each being a shutter member with a single slit, the portions being arranged so as to respectively correspond to the plurality of optical transmission members.

9. The exposure device according to claim 1,
wherein the housing is provided with a plurality of said optical transmission members for full-color images and a single said optical transmission member for monochrome images, and
wherein the shutter member includes two portions, one of the portions being a shutter member for full-color images having a plurality of said slits, and the other being a shutter member for monochrome images having a single said slit.

10. An image forming apparatus performing image formation by transferring a toner image obtained by developing a static latent image formed on a member to be scanned based on image data onto a recording medium, the image forming apparatus comprising:
an exposure device comprising a shutter member having a slit, the shutter member being provided between the member to be scanned and a housing of a main device unit that has an optical transmission member, and being freely movable between an open position at which the slit is in opposition to the optical transmission member and a shut position at which the slit is not in opposition to the optical transmission member, a light beam being irradiated through the optical transmission member and the slit to the member to be scanned to form the static latent image,
wherein in the exposure device, a depressed portion is provided below the slit, an aperture portion of the depressed portion being in opposition to the slit at least in a state where the shutter member is moved to the shut position at which a light path of the light beam is shut,
wherein lengths of the slit in a moving direction of the shutter member and in a direction perpendicular to the moving direction are shorter than lengths of the aperture portion, and
wherein a seal member is provided on the slit, a lower surface of the seal member being in contact with an entire circumference of an edge of the aperture portion in a state where the shutter member is moved to the shut position.

11. The image forming apparatus according to claim 10,
wherein in the exposure device, an upper surface of the seal member is fixed to the shutter member.

12. The image forming apparatus according to claim 11,
wherein the seal member includes a cleaning member that scrapes the optical transmission member.

13. The image forming apparatus according to claim 11,
wherein the cleaning member is a blade.

14. The image forming apparatus according to claim 10,
wherein the shutter member is provided with a projection portion extending toward the side opposed to the member to be scanned, of an edge of the slit at least on the moving direction side of the shutter member.

15. The image forming apparatus according to claim 14,
wherein a cross-sectional shape of an open end of the projection portion in the moving direction of the shutter member is inclined in a direction from an edge to a center of the slit with respect to the light path of the light beam.

16. The image forming apparatus according to claim 10,
wherein the housing has a plurality of said optical transmission members, and
wherein the shutter member is provided with a plurality of said slits respectively corresponding to the plurality of optical transmission members.

17. The image forming apparatus according to claim 10,
wherein the housing has a plurality of said optical transmission members, and
wherein the shutter member includes a plurality of portions each being a shutter member with a single slit, the portions being arranged so as to respectively correspond to the plurality of optical transmission members.

18. The image forming apparatus according to claim 10,
wherein the housing is provided with a plurality of said optical transmission members for full-color images and a single said optical transmission member for monochrome images, and
wherein the shutter member includes two portions, one of the portions being a shutter member for full-color images having a plurality of said slits, and the other being a shutter member for monochrome images having a single said slit.

* * * * *